United States Patent [19]

Dach

[11] Patent Number: 4,828,580

[45] Date of Patent: May 9, 1989

[54] QUENCH RING INSULATING COLLAR

[75] Inventor: Michael M. Dach, Houston, Tex.

[73] Assignee: Texaco Inc., White Plains, N.Y.

[21] Appl. No.: 226,922

[22] Filed: Aug. 1, 1988

[51] Int. Cl.[4] ..... C10J 3/48

[52] U.S. Cl. ..... 48/69; 48/DIG. 2; 55/256

[58] Field of Search ..... 48/197 R, 206, 76, 69, 48/63, 64, 77, DIG. 2; 55/240, 256; 422/207

[56] References Cited

U.S. PATENT DOCUMENTS

| | | | |
|---|---|---|---|
| 4,444,726 | 4/1984 | Crothy et al. | 48/69 |
| 4,624,683 | 11/1986 | Dach | 48/69 |
| 4,650,497 | 3/1987 | Quintana | 48/69 |
| 4,778,483 | 10/1988 | Martin et al. | 48/69 |

*Primary Examiner*—Peter Kratz

*Attorney, Agent, or Firm*—Robert A. Kulason; James J. O'Loughlin; Robert B. Burns

[57] ABSTRACT

Reactor for gasifying a carbonaceous fuel to produce a usable gas, and comprising an insulated outer shell. A reaction chamber within the shell receives a fuel mixture from an injection burner. The products or effluent of gasification include hot produced gases which are passed through a constricted throat to be cooled in a liquid bath. A dip tube, which guides the hot effluent into the bath, is provided with a stream of coolant from a quench ring. The latter is supported below the reaction chamber and is provided with a thermal barrier along its surface that is exposed to the hot produced gas. The barrier will reduce thermal stress in the quench ring and reduce drain of heat from the gasifier throat, thus avoiding premature chilling of the slag component.

4 Claims, 3 Drawing Sheets

QUENCH RING INSULATING COLLAR

BACKGROUND OF THE INVENTION

In the production of a usable synthesis gas by the combustion of a carbonaceous fuel mixture, the process is conducted most effectively under a high temperature and high pressure conditions. For example, for the production of a gas from a carbonaceous fuel such as particulated coal, coke or even oil, a preferred operating temperature range of about 2,000° to 3,000° F. is maintained at a pressure of between about 5 to 250 atmospheres. The harsh operating conditions experienced in such a process, and in particular the wide temperature variations encountered, will impose a severe strain on many segments of the gasifier or reactor units.

The invention is addressed to an improvement in the structure of the gasifier, and particularly in the quench ring and the dip tube arrangement. The latter, by their functions, are exposed to the gasifier's maximum temperature conditions by virtue of the hot product gas which makes contact with this member as it passes from the reaction chamber.

U.S. Pat. No. 4,218,423 issued on Aug. 19, 1980 in the name of Robin et al, illustrates one form of quench ring and dip tube which can be improved through use of the present arrangement. U.S. Pat. No. 4,444,726 issued on Apr. 24, 1984 in the name of Crotty et al, also illustrates a dip tube and quench ring for a reactor vessel.

In pending application Ser. No. 164,750, a form of quench ring protector is shown. This protection takes the form of a barrier or belt of heat resistant refractory material which is supported by the quench ring, contiguous with the external surface of the latter. The support member is embodied in a shelf or outwardly projecting member on which the refractory rests.

Among the problems encountered due to the high temperature conditions within the gasifier, is the development of thermal stresses. These often result in damage to the quench ring as a result of the ring's close proximity to the hot effluent stream. Such problems are frequently manifested in the form of cracks and fissures which develop and expand in parts of the quench ring. The latter usually occur in areas particularly where sharp corners are present such that any physical or thermal stress would be magnified, and eventually result in leakage of liquid coolant into the reactor chamber.

A further operational difficulty can be experienced in gasifiers of the type contemplated as a result of the propensity of molten slag to harden and freeze in the gasifier's constricted throat. This phenomena results when the throat section becomes sufficiently cool to reduce the slag temperature as the latter flows out of the reaction chamber.

This undesirable chilling action can under particular circumstances, severely block the constricted throat opening, thereby precluding further operations.

BRIEF DESCRIPTION OF THE INVENTION

Toward overcoming the stated operating defects in gasifiers of the type contemplated, there is presently disclosed a gasifier quench ring which is provided with a self supporting refractory face or liner along its exposed surfaces. It is thereby insulated to minimize thermal stresses which would be normally encountered during a gasification process. The refractory is positioned, and self supported by virtue of its configuration which allows it to be locked in place by its own weight.

Stated otherwise, there is presently provided a reactor for gasifying a carbonaceous fuel mixture to produce a hot effluent comprising residual slag and a useful synthesis gas. The reactor includes a reaction chamber in which the fuel mixture is gasified, the floor of said chamber being shaped to permit liquefied slag to flow therefrom.

A quench chamber holding a water bath is positioned in the reactor to receive and cool hot produced effluent. A constricted throat communicating the reaction chamber with the quench chamber directs a stream of the effluent through a dip tube which defines a guide passage to conduct said effluent into the water bath.

A toroidal shaped quench ring depending from the gasifier floor or wall supports the dip tube to direct a water stream against the dip tube's guide surface. A toroidal, refractory ring formed into a unitary member, or of a series of separate segments, is positioned adjacent to the quench ring. The refractory ring is preferably wedged into a constricted throat configuration to guide the hot effluent stream toward the water bath.

It is therefore an object of the invention to provide an improved gasifier for producing a usable gas, in which a gasifier dip tube is wetted by a quench ring. The latter embodies a thermally resistant, self supporting heat barrier which segregates the quench ring from the hot effluent as well as from hot segments of the gasifier.

A further object is to provide a liquid carrying quench ring for a gasifier, which is separated from hot effluent produced in the gasifier combustion chamber, by means of a thermally resistant self supporting refractory ring carried on the quench ring exposed surfaces.

A still further object is to provide a gasifier quench ring having a refractory liner or layer positioned to form a portion of the guide passage which conducts hot effluent gas between the gasifier's constricted throat and the water bath.

Figure 1:
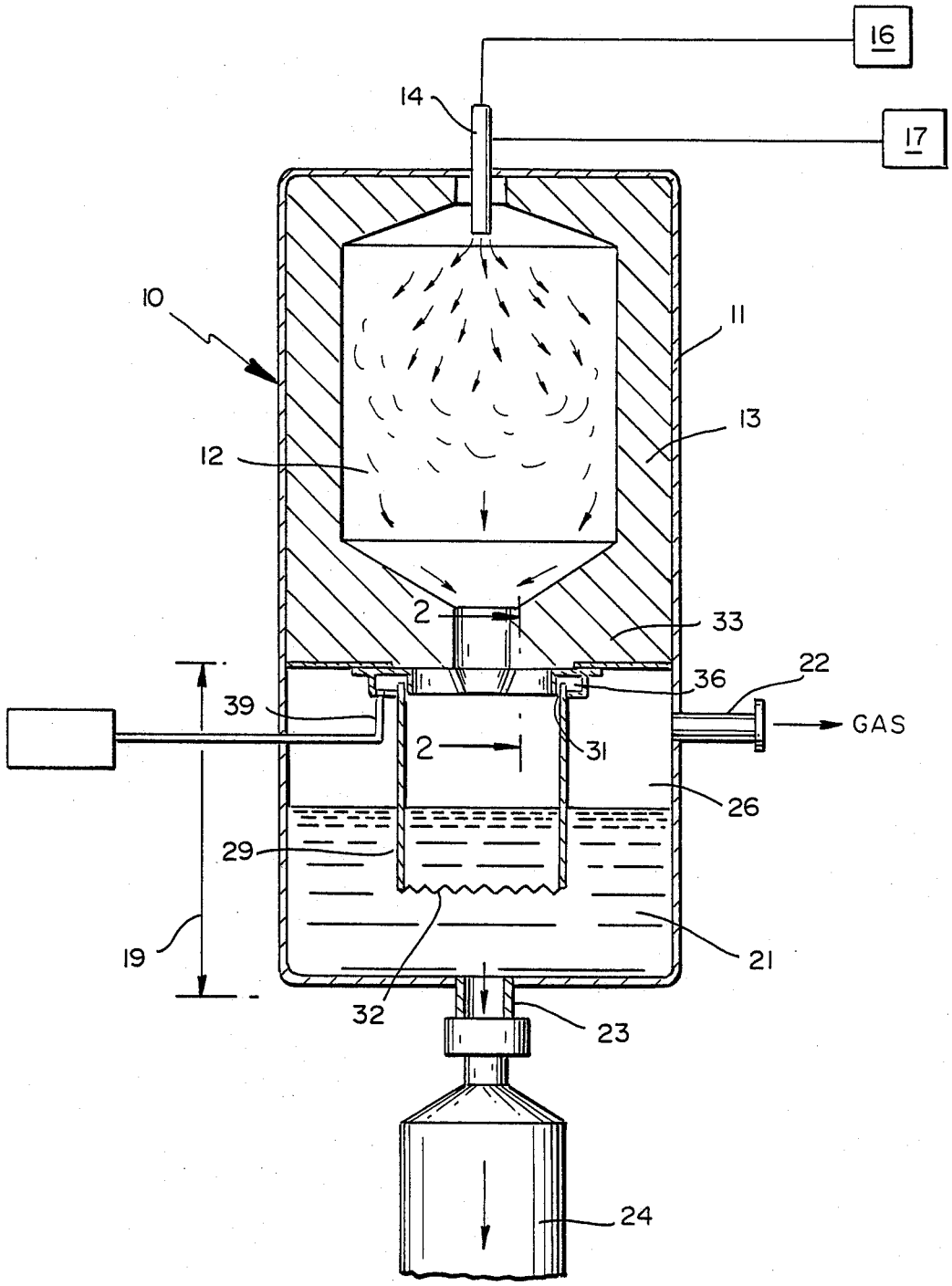
FIG. 1 is a vertical elevation view in cross-section of the gasifier or reactor of the type contemplated.

Briefly, in achieving the stated objectives, and referring to FIG. 1, there is provided a gasifier or reactor vessel for gasifying a carbonaceous fuel mixture either solid, liquid or gaseous. The process produces a hot effluent which includes a useful synthesis gas, and a residue normally in the form of particulated ash, when the fuel is a liquid such as a vacuum resid, or a solid such as coal or coke. The gasifier is embodied in a heavy walled steel shell which is positioned to form a downflowing stream of the effluent including the hot produced synthesis gas.

A reaction chamber within the shell receives a pressurized stream of the fuel mixture by way of the fuel injection burner. The latter is communicated with a source of the carbonaceous fuel as well as with a source of a gasification supporting gas such as oxygen or air to form a combustible mixture.

The products of gasification, or the hot effluent which is generated in the reaction chamber, is discharged downwardly through the reaction chamber floor to be cooled in a liquid holding quench chamber.

To facilitate passage of hot produced gas as it leaves the reaction chamber, a dip tube is positioned to guide the effluent into a liquid bath. The dip tube, oriented in a generally upright position, is supported by a liquid conducting quench ring which directs a stream of coolant such as water, along the dip tube's exposed guide face or inner wall. The quench ring is provided along its exposed face, with a refractory liner member which contacts the hot effluent.

Referring more specifically to FIG. 1, a gasifier or reactor vessel 10 of the type here contemplated, embodies an elongated metallic steel walled shell 11. The shell is normally aligned in an upright position to permit a downflowing stream of product. Shell 11 includes a reaction chamber 12 at the upper end. To withstand high operating temperatures between 2,000° to 3,000° F., chamber 12 is provided with a lined inner wall 13, preferably formed of a suitable refractory material.

A burner 14 is removably positioned at shell 11 upper wall to inject the carbonaceous fuel mixture such as particulated coal or coke from source 16, into reaction chamber 12. An amount of a gasification supporting gas from a pressurized source 17 is concurrently fed into burner 14 as a part of the fuel mixture.

The invention, as mentioned, can be applied equally as well to gasifiers which burn a variety of carbonaceous solid liquid, or gaseous fuels. To illustrate one embodiment of the invention, it will be assumed that burner 14 is communicated with a source 16 of particulated coke. The latter is preferably preground and formed into a slurry of desired consistency by the addition of a sufficient amount of water. The pressurized gas at source 17 is normally oxygen, air, or a mixture thereof.

The lower end of reaction chamber 12 is defined by a downwardly sloping refractory floor 33. This configuration enhances the discharge of hot gas and liquefied slag from the reaction chamber 12.

The lower end of shell 11 encloses a quench chamber 19 into which the products of gasification are directed. Here, both solid and gaseous products contact liquid coolant bath 21, which is most conveniently comprised of water. The cooled gas then emerges from quench bath 21 into disengaging zone 26 before leaving the quench chamber through line 22. The cooled gas is now processed in downstream equipment and operations into a usable form. The solid or slag component of the effluent sinks through bath 21 to be removed by way of discharge port 23 into lockhopper 24.

Reaction chamber 12 and quench chamber 19 are communicated through constricted throat 27 formed in the reaction chamber floor 33. To achieve efficient contact between the hot effluent as it leaves reaction chamber 12, with the liquid in bath 21, quench chamber 19 as noted is provided with a dip tube 29 having an upper edge 31 positioned just beneath constricted throat 27. Dip tube 29 further includes a lower edge 32 which terminates in the coolant bath 21.

Figure 2:
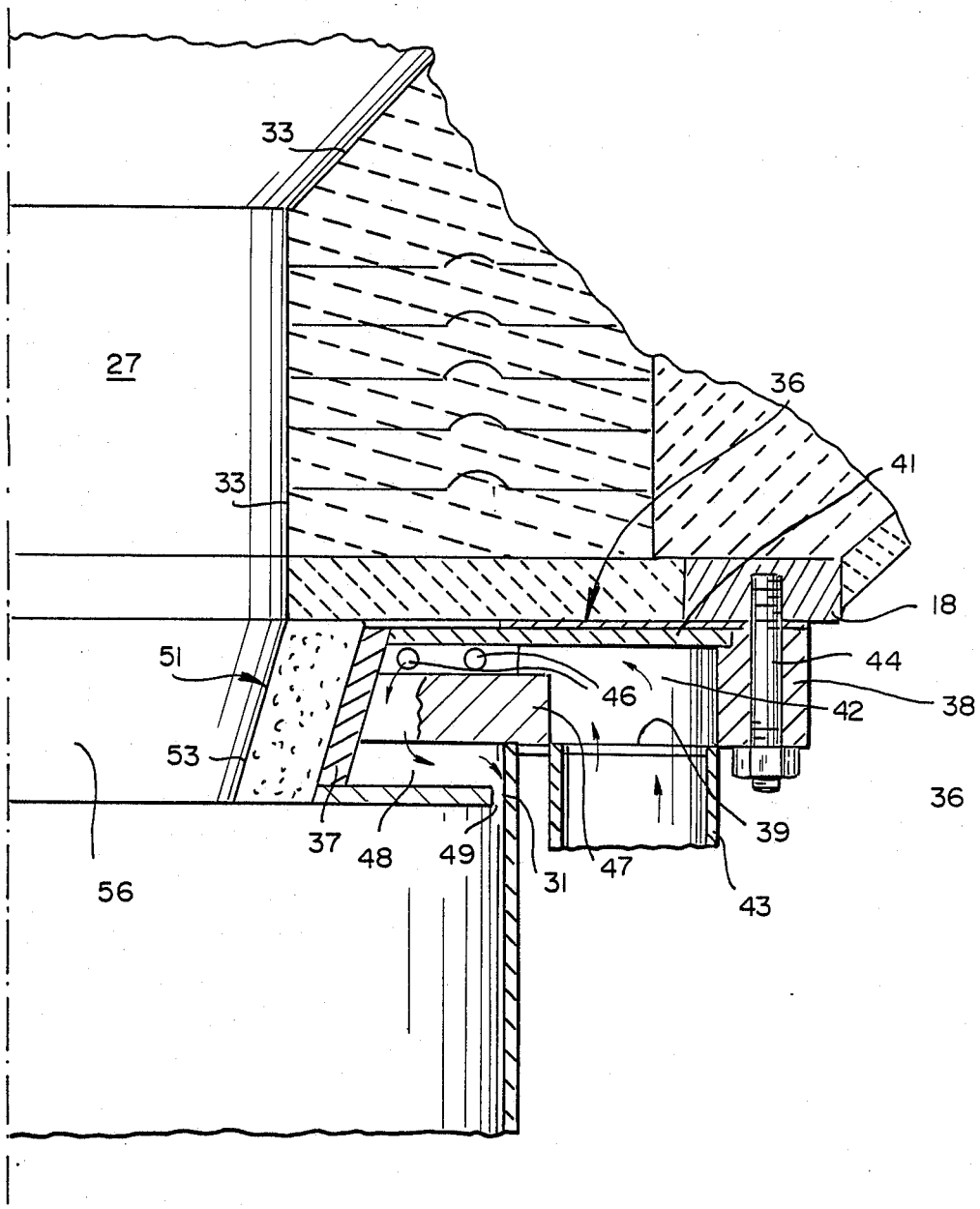
FIG. 2 is a segmentary enlarged view, taken along line 2—2 of FIG. 1.

Referring to FIG. 2, constricted throat 27 defines the initial guide passage through which the high temperature, high pressure effluent passes. Although cooling of the slag is desirable in quench chamber 19, premature cooling in, and immediately beneath throat 27, will prompt the formation of a solid accumulation or barrier to the gaseous flow. It is desirable therefore to minimize the loss of heat from throat 27, into adjacent coolant carrying quench ring 36.

Functionally, the inner wall of dip tube 29 defines a cylindrical guide path for the hot effluent including both the gaseous and solid components as they flow from throat 27 and into water bath 21.

Beneficially, the inner wall or guide surface of the cylindrical dip tube 29 is wetted by directing one or more pressurized streams of water thereagainst.

In one embodiment or configuration, quench ring 36 is comprised of spaced apart inner wall 37, and outer wall 38. Base plate 39 and upper plate 41 define annular toroidal manifold passage or chamber 42, or water distribution chamber which is closed by annular plate or wall 47 and which is communicated with a pressurized source of water by way of one or more risers 43. The water will be directed inwardly by a series of radial ports 46 into annular quench chamber 48. From the latter, the coolant will flow by way of one or more distribution openings 49, along the face of dip tube 29.

Quench ring 36 is removably fastened in place beneath the floor of combustion chamber 12 by a plurality of fastening bolts 44 through outer wall 38.

To position an insulating ring or collar 51, inner wall or plate 37 is formed to define a frusto conical cavity which terminates at a lower constricted opening. Insulating collar 51 is similarly formed into a frusto conical configuration, allowing it to become firmly supported into cavity 56. The inner peripheral face of wall 37 bears laterally against collar 51, thereby permitting the latter to expand at expected elevated operating temperatures, but nonetheless to maintain its relative position regardless of the adjustment of the metallic quench ring 36 due to thermal expansion or contraction.

Collar 51 is preferably fabricated of a refractory material capable of withstanding the hot effluent temperature. The collar, as shown, takes the configuration of a single, or multiple segment, ring-like member to slidably fit into constricted cavity 56 without the benefit of bolts or other positive fastening means. In the shown embodiment, the collar's normally exposed surface is aligned such that the hot effluent stream will be further narrowed as it leaves throat 27.

Figure 3:
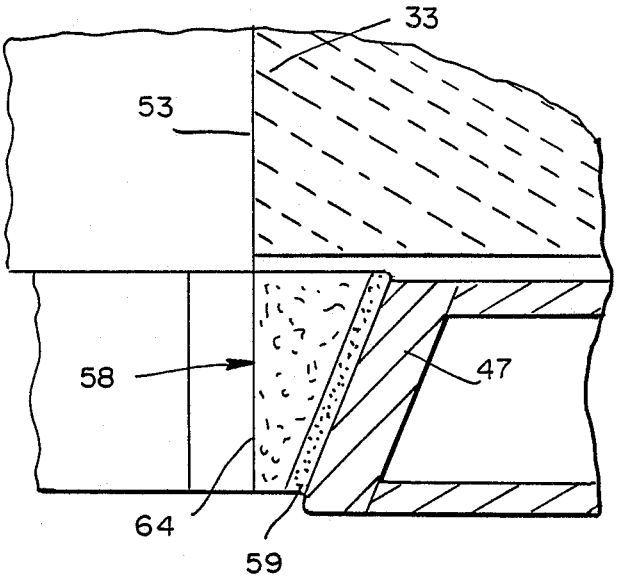
FIG. 3 is an enlarged cross-sectional view take along line 3—3 in FIG. 1.
Figure 4:
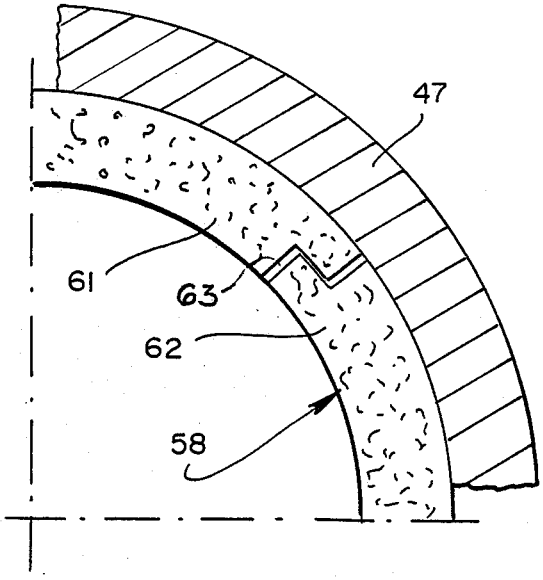
FIG. 4 is an enlarged view taken along line 4—4 in FIG. 3.

In an alternate embodiment, and as shown in FIG. 3, refractory collar 58 can be provided with a cylindrical configuration along its inner surface 64 to form an extension to the constricted throat 53. As shown in FIG. 4, collar 58 can further be formed of a plurality of cooperating ring segments 61 and 62, having the lateral edges overlapping and fitted into a slidable joint 63. Thus, thermal adjustment of either the quench ring, or the insulating collar will not alter the latter's insulating effectiveness.

In the segmented configuration of ring 58, the entire unit, or individual segments, can be readily replaced in the event of wear or erosion. With such a construction, the period for cooling down a reactor to permit internal work, is greatly reduced.

To supplement the function of the quench ring's insulating collar, a fiber board or similar member 59 can be positioned between the quench ring exposed face and the insulating collar. The latter will thus be capable of a more close and effective fit when set into place.

It is understood that although modifications and variations of the invention can be made without departing from the spirit and scope thereof, only such limitations should be imposed as are indicated in the appended claims.

I claim:

1. In a reactor for gasifying a carbonaceous fuel mixture to produce a hot effluent comprising a residual slag and useful synthesis gas, which reactor includes:

a shell having a reaction chamber in which the fuel mixture is gasified, means defining a quench chamber in said shell holding a water bath in which said hot effluent is cooled, means defining a constricted throat communicating the reaction chamber with said quench chamber, a dip tube having guide walls downwardly extending from said constricted throat to define an effluent guide passage for conducting hot effluent from said constricted throat, into the water bath, means defining a toroidal quench ring adjacent to said dip tube and communicated with a pressurized source of water to wet said guide walls, said quench ring including an inner wall which defines a frusto conical cavity, in alignment with said constricted throat, and a toroidal, temperature resisting collar registered and supported in said frusto conical cavity and defining a segment of said effluent guide passage, wherein said temperature resisting collar is supported in said cavity without positive fastening to allow unrestrained thermal expansion thereof.

2. In the apparatus as defined in claim 1, wherein said temperature resisting collar is comprised of:

a plurality of circularly arranged collar segments.

3. In the apparatus as defined in claim 1, wherein said temperature resisting collar is formed of a castable refractory material.

4. In the apparatus as defined in claim 1, wherein said temperature resisting collar includes:

a substantially cylindrical inner face which defines a segment of said effluent guide passage.

* * * * *